US007121985B2

(12) United States Patent
Cheng

(10) Patent No.: US 7,121,985 B2
(45) Date of Patent: Oct. 17, 2006

(54) EXERCISER HAVING ACTUATABLE MASSAGE DEVICE

(76) Inventor: Kao Pin Cheng, P.O. Box 1282, Chang Hua (TW) 500

( * ) Notice: Subject to any disclaimer, the term of this patent is extended or adjusted under 35 U.S.C. 154(b) by 430 days.

(21) Appl. No.: 10/793,409

(22) Filed: Mar. 2, 2004

(65) Prior Publication Data

US 2005/0202937 A1 Sep. 15, 2005

(51) Int. Cl.
*A63B 22/06* (2006.01)
*A63B 26/00* (2006.01)
*A61H 15/00* (2006.01)

(52) U.S. Cl. ..... 482/57; 57/142; 601/90; 601/122

(58) Field of Classification Search ..... 482/51, 482/57, 93, 94, 96, 140, 142; 601/24, 29, 601/32–36, 49, 52–54, 89, 90, 115, 116, 122, 601/126–128
See application file for complete search history.

(56) References Cited

U.S. PATENT DOCUMENTS 3,658,327 A 4/1972 Thiede ..... 272/79 R
3,727,608 A * 4/1973 Simsian ..... 601/146
3,945,637 A * 3/1976 Simjian ..... 482/62
4,004,801 A * 1/1977 Campanaro et al. ..... 482/96
4,101,124 A 7/1978 Mahnke ..... 272/134
4,383,684 A 5/1983 Schliep ..... 272/120
4,534,553 A * 8/1985 Shirley ..... 482/65
4,706,953 A 11/1987 Graham ..... 272/120
4,768,776 A 9/1988 Giannotti ..... 272/72
5,215,511 A * 6/1993 Cheng ..... 482/121
5,913,758 A * 6/1999 Nunez ..... 482/142
5,938,571 A 8/1999 Stevens ..... 482/96
5,967,950 A * 10/1999 Hsu ..... 482/96

* cited by examiner

*Primary Examiner*—Jerome Donnelly
*Assistant Examiner*—Tam Nguyen
(74) *Attorney, Agent, or Firm*—Charles E. Baxley

(57) ABSTRACT

An exerciser includes a carriage slidably supported on a supporting base for supporting users and having a number of massage members for massaging the users. A moving device may be used to move the carriage relative to the supporting base and thus to move the massage members relative to the users, and to massage the users with the massage members. The moving device includes an eccentric rotary member rotatably attached to the supporting base, and a coupling device coupling the eccentric rotary member to the carriage and to move the carriage relative to the supporting base when the eccentric rotary member is rotated by users.

15 Claims, 5 Drawing Sheets

EXERCISER HAVING ACTUATABLE MASSAGE DEVICE

BACKGROUND OF THE INVENTION

1. Field of the Invention

The present invention relates to an exerciser, and more particularly to an exerciser having a massage device selectively movable or actuatable relative to a supporting device by users.

2. Description of the Prior Art

Various kinds of typical exercisers have been developed and comprise a carriage slidably supported on one or more tracks or rails, and movable or actuatable to move along the tracks or rails by such as pulling forces of users.

For example, U.S. Pat. No. 3,658,327 to Thiede discloses one of the typical pull type exercising device and comprises a carriage slidably supported on two deck portions that may be folded to a compact configuration. However, the carriage may not be moved relative to the users and may not be used to massage the users.

U.S. Pat. No. 4,101,124 to Mahnke discloses a similar typical pull type exercising device and comprises a carriage slidably supported on a track member which includes an integral one-piece structure that may not be folded to a compact configuration. In addition, similarly, the carriage also may not be moved relative to the users and may not be used to massage the users.

U.S. Pat. No. 4,383,684 to Schliep discloses a further typical weight moving device and comprises a carriage slidably supported on one or more foldable rails which may be folded to compact configuration. However, similarly, the carriage also may not be moved relative to the users and may not be used to massage the users.

U.S. Pat. No. 4,706,953 to Graham discloses another typical active/passive exercising device and also comprises a carriage slidably supported on track members. However, similarly, the carriage also may not be moved relative to the users and may not be used to massage the users.

U.S. Pat. No. 4,768,776 to Giannotti discloses a still further rowing exercise device and comprises a carriage slidably supported on the ground and movable relative to double tracks. However, similarly, the carriage also may not be moved relative to the users and may not be used to massage the users.

U.S. Pat. No. 5,93,571 to Stevens discloses a still further typical folding exercise device and also comprises a carriage slidably supported on rails which include a structure that may be easily folded to a compact configuration. However, similarly the carriage also may not be moved relative to the users and may not be used to massage the users.

The present invention has arisen to mitigate and/or obviate the afore-described disadvantages of the conventional exercisers.

SUMMARY OF THE INVENTION

The primary objective of the present invention is to provide an exerciser including a massage device selectively movable or actuatable relative to a supporting device by users.

The other objective of the present invention is to provide an exerciser including a foldable supporting device selectively foldable when actuated by the users.

In accordance with one aspect of the invention, there is provided an exerciser comprising a supporting base, a carriage slidably supported on the supporting base for supporting users, and including a plurality of massage members provided thereon for engaging with and for massaging the users, and a moving device for moving the carriage relative to the supporting base to move the massage members relative to the users, and to massage the users with the massage members.

A biasing device may further be provided for biasing the carriage relative to the supporting base. The carriage includes a plurality of rods provided therein to support the massage members.

The supporting base includes at least one track provided therein to slidably support the carriage on the track. The supporting base includes a plurality of fasteners attached to the track and engaged with the carriage, to adjust the carriage relative to the track and the supporting base. One or more rails may further be provided and disposed between the fasteners and the carriage.

The moving device includes an eccentric rotary member rotatably attached to the supporting base, and a coupling deivce for coupling the eccentric rotary member to the carriage to move the carriage relative to the supporting base when the eccentric rotary member is rotated relative to the supporting base. The coupling device includes a rotary member attached to the carriage, and a connecting member engaged over the rotary member of the carriage and the eccentric rotary member. The supporting base includes at least one rotary member attached thereto and engaged with the connecting member.

The moving device includes a pair of cranks and foot pedals attached to the eccentric rotary member to rotate and drive the eccentric rotary member relative to the supporting base.

The supporting base includes a first deck member and a second deck member pivotally secured together, to allow the first and the second deck members to be folded relative to each other, the carriage is slidably supported on the second deck member.

One or more catches may further be provided for selectively securing the carriage to the second deck member and to prevent the carriage from sliding relative to the second deck member. One or more latches may further be provided for selectively securing the first and the second deck members together, to prevent the first and the second deck members from folding relative to each other.

The first deck member includes at least one projection extended therefrom, the second deck member includes an opening formed therein to receive the projection of the first deck member. The supporting base includes a seat, the first deck member including a first end pivotally secured to the seat, and a second end pivotally secured to the second deck member. The second deck member includes a first end pivotally secured to the first deck member, and a second end having at least one wheel attached thereto.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
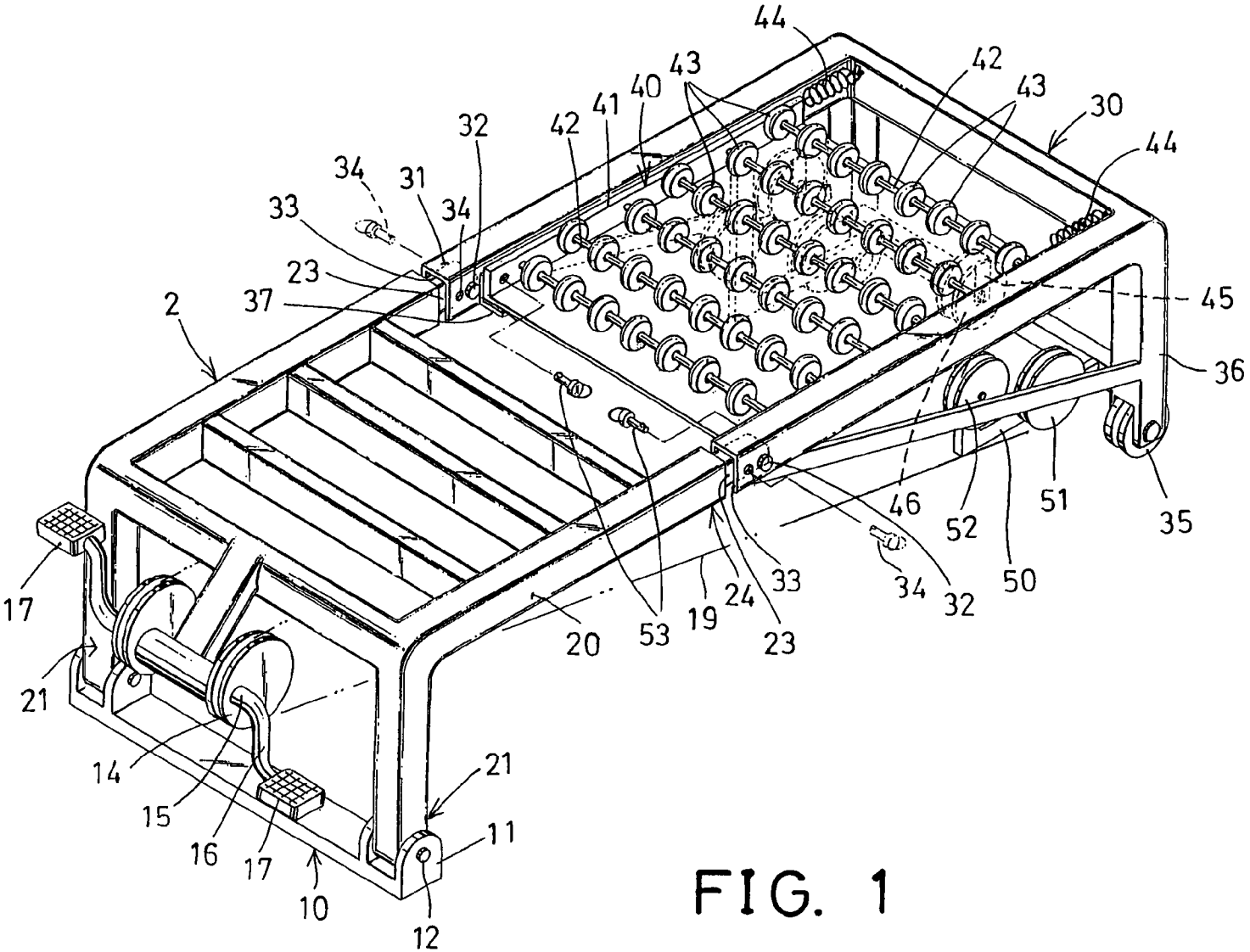
FIG. 1 is a perspective view of an exerciser in accordance with the present invention.
Figure 2:
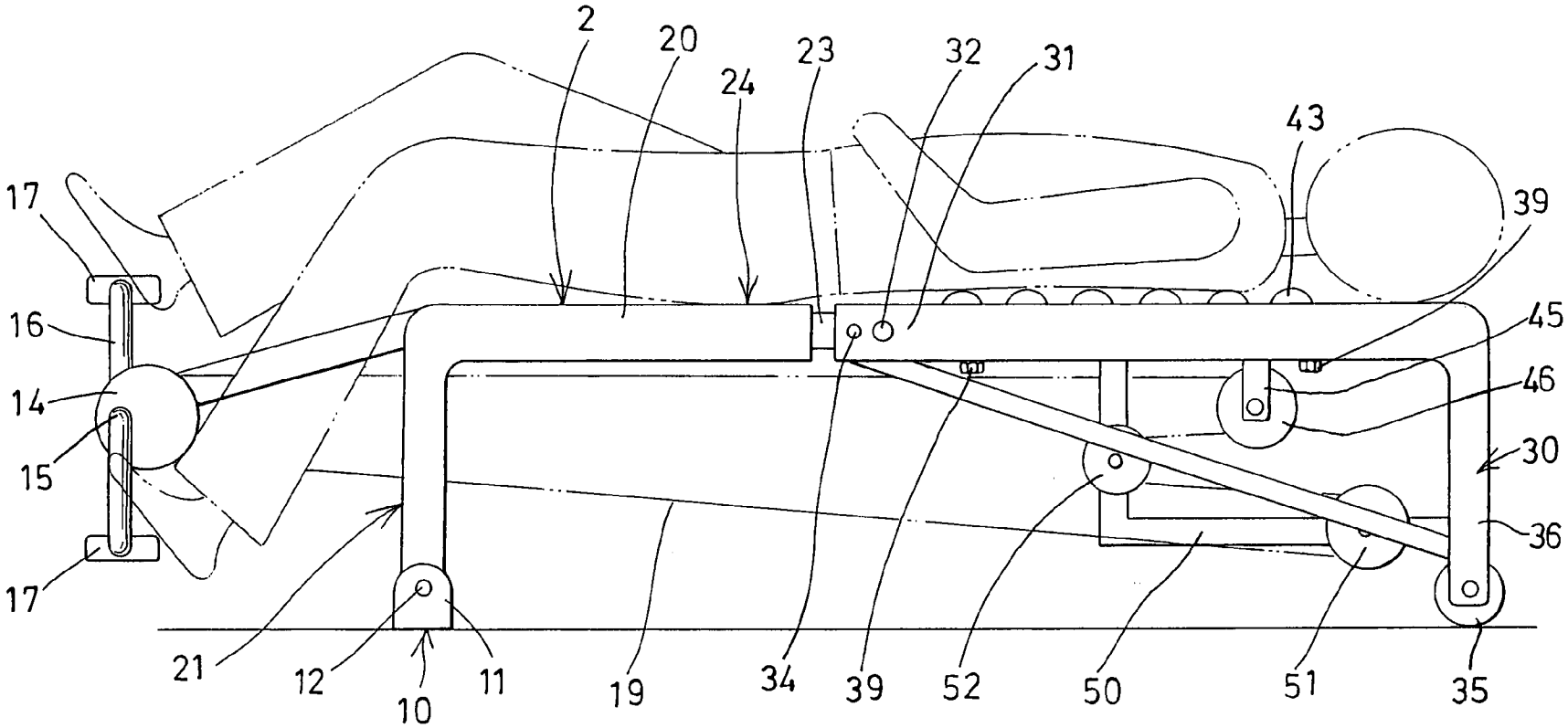
FIG. 2 is a side plan view of the exerciser.

Referring to the drawings, and initially to FIGS. 1 and 2, an exerciser in accordance with the present invention comprises a ground engaging seat 10 for being disposed on and supported by the ground and including one or more ears 11 extended therefrom for receiving pins 12 thereon.

Figure 6:
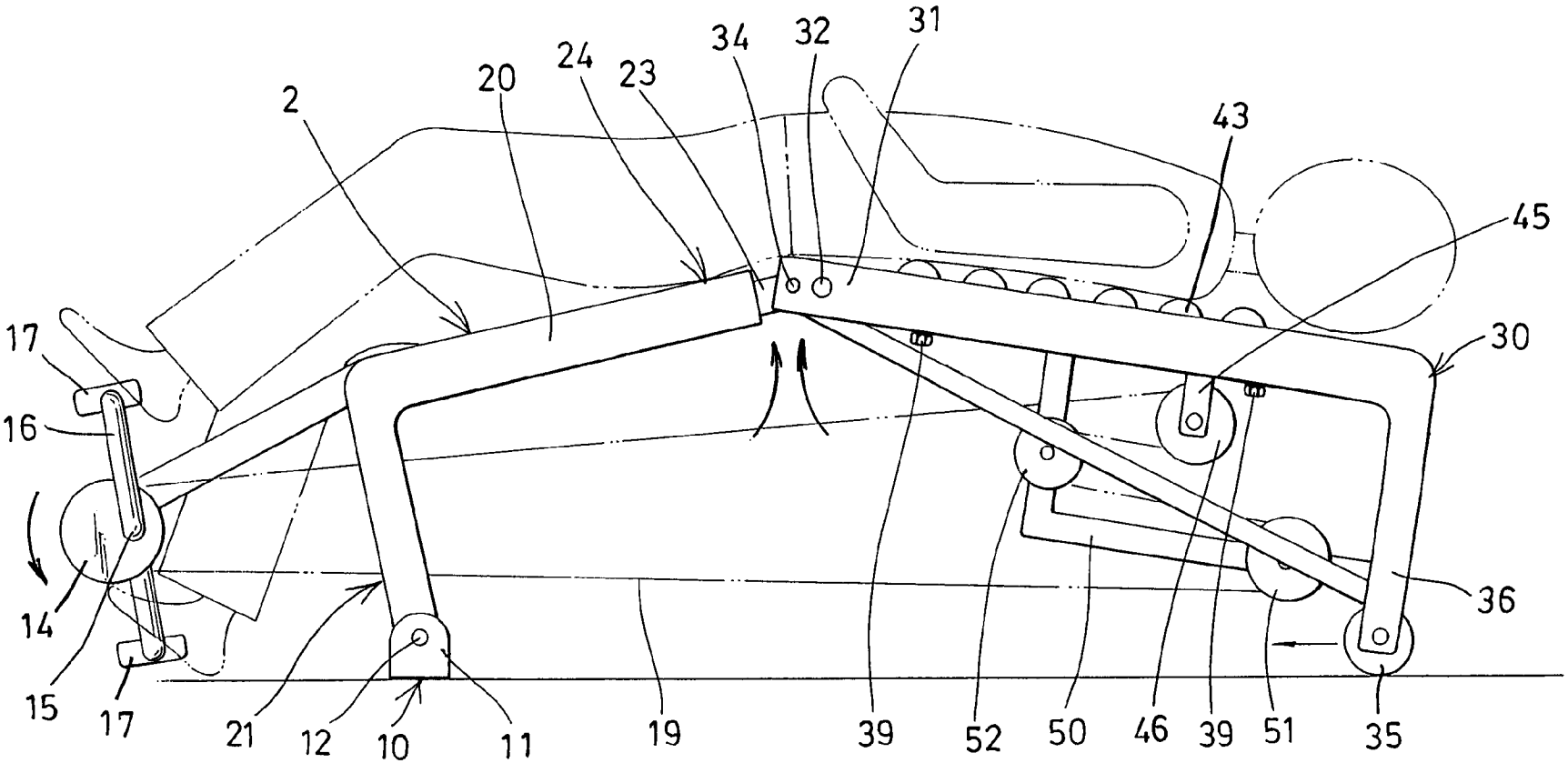
FIG. 6 is a side plan view similar to FIG. 2, illustrating the further operation of the exerciser.

A supporting base 2 includes a first deck member 20 having one end 21 or lower portion pivotally secured to the seat 10 with the pins 12, for allowing the supporting base 2 to be rotated relative to the seat 10 and the supporting ground, and having one or more such as two projections 23 extended from the other end 24 thereof. The first deck member 20 of the supporting base 2 may be used to support the users, such as the buttocks of the users (FIGS. 2, 6).

One or more, such as two cams or sprockets or pulleys or wheels or rotary members 14 are rotatably and eccentrically attached to the first deck member 20 of the supporting base 2 with a spindle 15, and two cranks 16 are extended from the spindle 15 for supporting foot pedals 17 thereon, and for allowing the users to rotate or drive the cams or eccentric rotary members 14. One or more, such as two chains or belts or connecting members 19 are engaged over the sprockets or rotary members 14.

The supporting base 2 includes a second deck member 30 having an upper portion or one end 31 pivotally secured to such as the projections 23 of the first deck member 20 with one or more pivot axles 32. For example, the one end 31 of the second deck member 30 includes one or more, such as two openings 33 formed therein for receiving the projections 23 of the first deck member 20.

The openings 33 of the second deck member 30 are preferably opened downwardly for allowing the deck members 20, 30 to be rotated or folded upwardly (FIG. 6), but may prevent the deck members 20, 30 from being rotated or folded downwardly (FIGS. 1–3 and 5).

One or more, such as two fasteners or pins or latches 34 may be selectively engaged through the projections 23 and the ends 31 of the deck members 20, 30 to selectively secure the deck members 20, 30 together (FIGS. 1–3 and 5), and to prevent the deck members 20, 30 from being rotated or folded relative to each other. The deck members 20, 30 may be rotated or folded relative to each other only when the latches 34 are disengaged from the projections 23 and the ends 31 of the deck members 20, 30.

Figure 3:
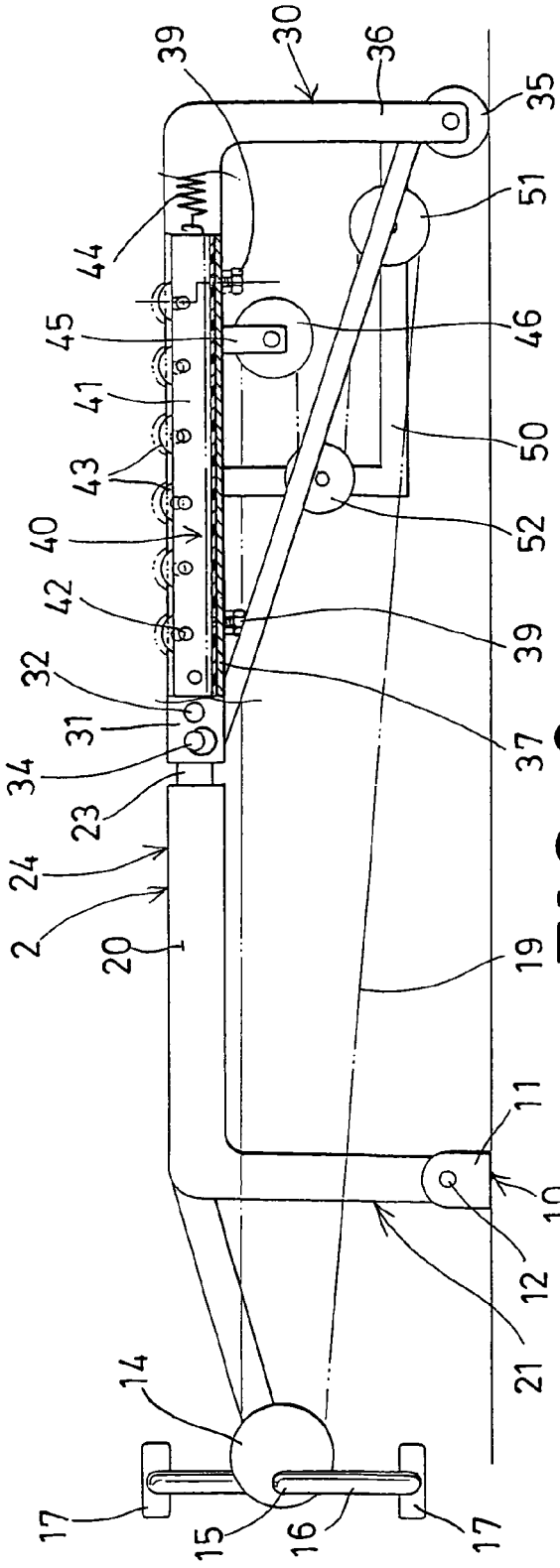
FIG. 3 is a side plan view similar to FIG. 2, in which a portion of the exerciser is cut off to show an inner structure of the exerciser.

The supporting base 2 further includes one or more, such as two wheels 35 attached to the other end 36 of the second deck member 30, to allow the second deck member 30 to be easily moved relative to the supporting ground, and for facilitating the folding operation between the deck members 20, 30. The supporting base 2 further includes one or more, such as two tracks 37 oppositely provided or attached therein (FIGS. 1, 3, 5).

Figure 4:
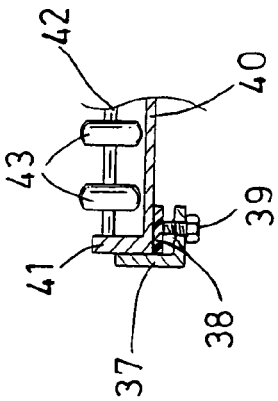
FIG. 4 is an enlarged partial cross sectional view of the exerciser.

A carriage 40 is slidably engaged onto and supported by the tracks 37, and includes two side walls 41, and one or more rods 42 secured between the side walls 42, and a number of massage members 43, such as wheels or rollers 43 attached onto the rods 42, for massaging purposes. It is preferable that each of the tracks 37 includes a rail 38 slidably disposed therein for engaging with the carriage 40 (FIG. 4), and a number of fasteners 39 threaded to the tracks 37 and engaged with the rails 38, to adjust the height of the carriage 40 relative to the second deck member 30 of the supporting base 2 (FIG. 3).

Figure 5:
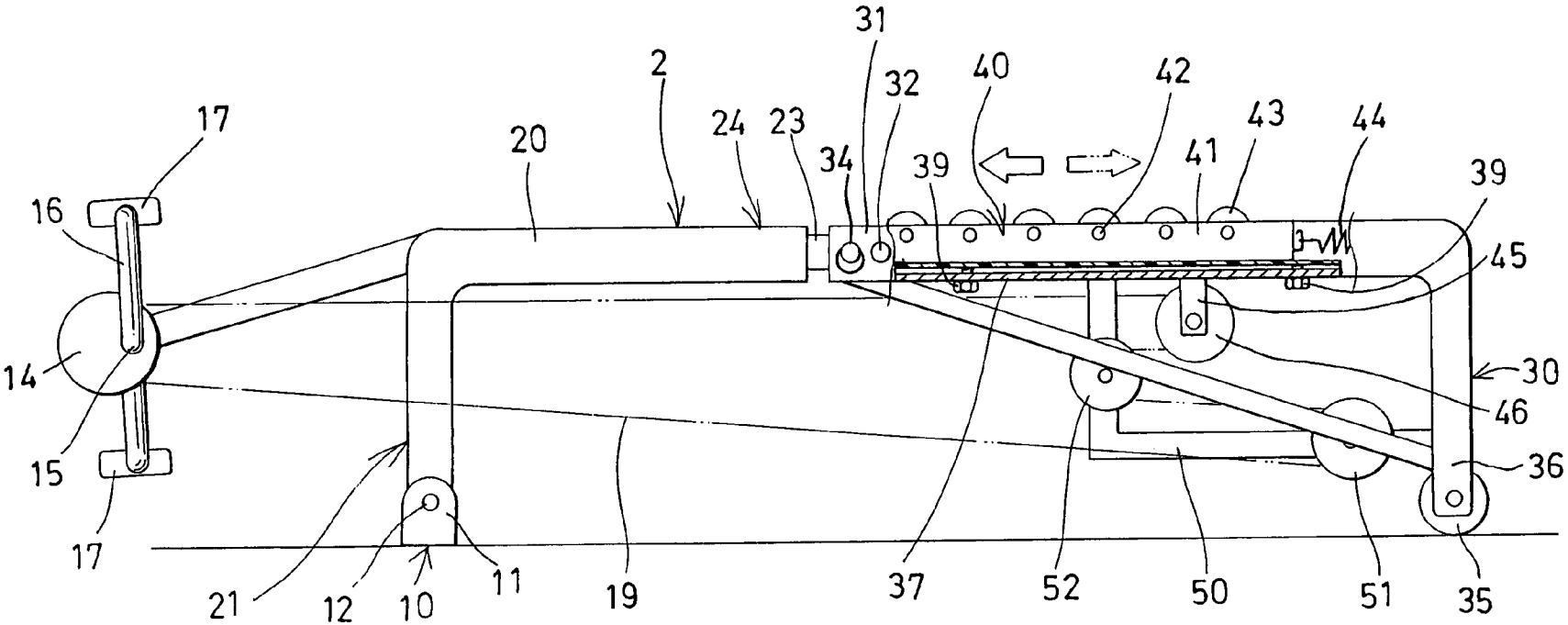
FIG. 5 is a side plan view similar to FIG. 3, illustrating the operation of the exerciser.

One or more, such as two spring members 44 are further provided and coupled between the carriage 40 and the second deck member 30 of the supporting base 2 (FIGS. 1, 3, 5), to bias or move or recover the carriage 40 relative to the second deck member 30 (FIG. 5). The carriage 40 includes one or more, such as two brackets 45 extended downwardly therefrom each to support a wheel or a sprocket or a pulley or a rotary member 46 thereon.

The second deck member 30 includes one or more, such as two frames 50 extended therefrom or secured thereto or provided thereon. One or more, such as two wheel or sprockets or pulleys or rotary members 51, 52 may further be provided and attached onto the frames 50 respectively. The chains or belts 19 are engaged over the sprockets or wheels or pulleys or rotary members 14, 46, 51, 52 respectively for coupling the cams or eccentric rotary members 14 to the carriage 40 and the second deck member 30.

One or more, such as two fasteners or pins or catches 53 (FIG. 1) may be selectively engaged through the carriage 40 and the second deck member 30 to selectively secure the carriage 40 and the second deck member 30 together, and to prevent the carriage 40 from being slid relative to the second deck member 30.

In operation, as shown in FIG. 5, when the fasteners or pins or catches 53 are not engaged through the carriage 40 and the second deck member 30, the carriage 40 will not be secured to the second deck member 30 and may thus slide relative to the second deck member 30.

When the cams or eccentric rotary members 14 are rotated or actuated by the users, the rotary member s 46 and thus the carriage 40 may be moved relative to the second deck member 30 by the cams or eccentric rotary member s 14 via the chains or belts 19. The spring members 44 may bias or move or recover the carriage 40 relative to the second deck member 30, to allow the carriage 40 to be forced or actuated to slide relative to the second deck member 30 in reciprocating action by the cams or eccentric rotary members 14 and the spring members 44.

The wheels or rollers or massage members 43 of the carriage 40 may thus be used to engage with and to massage the users when the carriage 40 is forced or actuated to slide relative to the second deck member 30 in the reciprocating action and when the carriage 40 is moved relative to the users.

Alternatively or selectively, when the carriage 40 is secured to the second deck member 30 with the catches 53, the carriage 40 may not be slid relative to the second deck member 30. At this moment, when the latches 34 are disengaged from the projections 23 and the ends 31 of the deck members 20, 30, the carriage 40 and thus the second deck member 30 may be forced and moved toward the first deck member 20 by the cams or eccentric rotary members 14 via the chains or belts 19, to allow the deck members 20, 30 to be rotated or folded upwardly to the upwardly folded structure as shown in FIG. 6.

The deck members 20, 30 may then be forced to be rotated or folded downwardly toward the planar or horizontal or unfolded position or structure by such as the weight of the users, or when the cams or eccentric rotary members 14 and the chains 19 no longer apply force against the rotary members 46 of the carriage 40. The carriage 40 and the second deck member 30 may thus be forced and moved toward and away from the first deck member 20 in reciprocating action by the cams or eccentric rotary members 14 via the chains or belts 19.

Accordingly, the exerciser includes a massage device selectively movable or actuatable relative to a supporting device by users, and includes a foldable supporting device selectively foldable when actuated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a supporting base including a seat, and including a first deck member and a second deck member pivotally secured together, to allow said first and said second deck members to be folded relative to each other, said first deck member including a first end pivotally secured to said seat, and including a second end, said second deck member including a first end pivotally secured to said second end of said first deck member, and including a second end, said first and said second deck members being arranged to allow said first and said second deck members to be folded upwardly relative to each other, but to prevent said first and said second deck members from being folded downwardly relative to each other, a carriage slidably supported on said supporting base for supporting users, and including a plurality of massage members provided thereon for engaging with and for massaging the users, and means for moving said second deck member relative to said first deck member to move and fold said second deck member relative to the users and means for moving said carriage relative to said supporting base to move said massage members relative to the users, and to massage the users with said massage members, wherein said means for moving the carriage includes an eccentric rotary member rotatably attached to said supporting base, a pair of cranks and foot pedals attached to said eccentric rotary member to rotate and drive said eccentric rotary member relative to said supporting base, and means for coupling said eccentric rotary member to said carriage to move said carriage relative to said supporting base when said eccentric rotary member is rotated.

2. The exerciser as claimed in claim 1 further comprising at least one latch selectively securing said first and said second deck members together, to prevent said first and said second deck members from folding relative to each other.

3. The exerciser as claimed in claim 1, wherein said first deck member includes at least one projection extended from said second end thereof, said second deck member includes an opening formed in said first end thereof to receive said at least one projection of said first deck member, and arranged to allow said first and said second deck members to be folded upwardly relative to each other, but to prevent said first and said second deck members from being folded downwardly relative to each other.

4. The exerciser as claimed in claim 1 further comprising means for biasing said carriage relative to said supporting base.

5. The exerciser as claimed in claim 1, wherein said carriage includes a plurality of rods provided therein to support said massage members.

6. The exerciser as claimed in claim 1, wherein said supporting base includes at least one track provided therein to slidably support said carriage on said at least one track.

7. The exerciser as claimed in claim 6, wherein said supporting base includes a plurality of fasteners attached to said at least one track and engaged with said carriage, to adjust said carriage relative to said at least one track and said supporting base.

8. The exerciser as claimed in claim 7 further comprising at least one rail disposed between said fasteners and said carriage.

9. The exerciser as claimed in claim 1, wherein said coupling means includes a rotary member attached to said carriage, and a connecting member engaged over said rotary member of said carriage and said eccentric rotary member.

10. The exerciser as claimed in claim 9, wherein said supporting base includes at least one rotary member attached thereto and engaged with said connecting member.

11. The exerciser as claimed in claim 1, wherein said carriage is slidably supported on said second deck.

12. The exerciser as claimed in claim 11 further comprising at least one catch selectively securing said carriage to said second deck member to selectively prevent said carriage from sliding relative to said second deck member.

13. The exerciser as claimed in claim 11 further comprising at least one latch selectively securing said first and said second deck members together, to prevent said first and said second deck members from folding relative to each other.

14. The exerciser as claimed in claim 13, wherein said first deck member includes at least one projection extended therefrom, said second deck member includes an opening formed therein to receive said at least one projection of said first deck member.

15. The exerciser as claimed in claim 1, wherein said second deck member includes a second end having at least one wheel attached thereto.

* * * * *